US007913880B2

(12) United States Patent
Chia

(10) Patent No.: US 7,913,880 B2
(45) Date of Patent: Mar. 29, 2011

(54) SQUIRTING TOY INCLUDING A SUPPLEMENTAL RESERVOIR SYSTEM AND METHODS THEREOF

(75) Inventor: Francis See Chong Chia, Kowloon (HK)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 12/725,842

(22) Filed: Mar. 17, 2010

(65) Prior Publication Data

US 2010/0170920 A1 Jul. 8, 2010

Related U.S. Application Data

(63) Continuation-in-part of application No. 11/860,617, filed on Sep. 25, 2007, now Pat. No. 7,571,837, which is a continuation-in-part of application No. 10/942,326, filed on Sep. 16, 2004, now Pat. No. 7,281,642.

(51) Int. Cl.
*B67D 7/60* (2010.01)

(52) U.S. Cl. ..... 222/386; 222/79; 446/153

(58) Field of Classification Search ..... 222/386, 222/518, 511, 513, 79, 409, 212; 446/153, 446/473, 476; 92/246; 482/55
See application file for complete search history.

(56) References Cited

U.S. PATENT DOCUMENTS

| | | | |
|---|---|---|---|
| 213,050 | A | 3/1879 | Lewis |
| D26,839 | S | 3/1897 | Lines |
| 1,031,526 | A | 7/1912 | Cloud, Jr. |
| 1,394,456 | A | 10/1921 | Wanat |
| D60,050 | S | 12/1921 | Mohler |
| 2,573,375 | A | 10/1951 | Winsted |
| 3,299,891 | A | 1/1967 | Smeton |
| D225,755 | S | 1/1973 | Hale |
| 3,884,229 | A | 5/1975 | Raines et al. |
| D240,130 | S | 6/1976 | Folke |
| 4,193,517 | A | 3/1980 | Fetty et al. |
| 4,274,223 | A | 6/1981 | Morrison et al. |
| D262,079 | S | 12/1981 | Rankin |
| 4,383,387 | A | 5/1983 | Puskar |
| 4,548,190 | A | 10/1985 | Megargee |

(Continued)

FOREIGN PATENT DOCUMENTS

GB 2045097 A 10/1980

OTHER PUBLICATIONS

U.S. Appl. No. 29/302,703, filed Jan. 23, 2008, entitled "Face for Squirting Toy Handle", inventor: Francis Cia (now abandoned).

(Continued)

*Primary Examiner* — Lien T Ngo

(74) *Attorney, Agent, or Firm* — Amster, Rothstein & Ebenstein LLP

(57) ABSTRACT

A squirting toy capable of squirting water received from a reservoir and/or from an external source. The squirting toy can include a housing, a piston, a shaft, and an handle portion. As the piston is slidably moved through the housing the water can be squirted out of the housing. Water can be drawn in from an external source by placing a part of the housing in the water and slidably moving the piston through the housing. Water can also be drawn in from a water reservoir (e.g., a standard water bottle).

37 Claims, 12 Drawing Sheets

U.S. PATENT DOCUMENTS 4,597,527 A 7/1986 Sands
4,627,796 A 12/1986 Moore
4,673,007 A 6/1987 Huang
4,689,033 A * 8/1987 Droller et al. ..... 446/183
4,733,799 A * 3/1988 Wiskur ..... 222/79
4,796,785 A 1/1989 Merritt
4,809,483 A 3/1989 Lovik
4,919,600 A 4/1990 Yang
4,963,847 A 10/1990 Cambreleng et al.
D315,095 S 3/1991 Wright
5,009,413 A 4/1991 Allen
D320,469 S 10/1991 Hoenig
5,061,252 A 10/1991 Dragosits
5,120,261 A 6/1992 Dietzman
D328,248 S 7/1992 Ruff
5,181,644 A 1/1993 Ferrell
5,199,114 A 4/1993 Christopher
D336,354 S 6/1993 Ringe
D336,668 S * 6/1993 D'Andrade ..... D21/572
D337,354 S 7/1993 Childs
5,224,633 A 7/1993 Senart
D338,697 S 8/1993 Salmon et al.
5,231,951 A 8/1993 Tagar et al.
D339,616 S 9/1993 Flaherty
5,255,708 A 10/1993 Liparoto et al.
5,256,099 A 10/1993 Rudell et al.
5,266,069 A 11/1993 Thorne
D344,311 S 2/1994 Liu
D344,556 S 2/1994 Liu
5,305,918 A 4/1994 D'Andrade
D351,007 S 9/1994 Bednar et al.
5,350,058 A 9/1994 Keough
D352,093 S 11/1994 Snycha
D354,093 S 1/1995 Hamlin
5,389,033 A 2/1995 Rauch
D357,886 S 5/1995 Fuller
D358,185 S 5/1995 Hope, II
D360,439 S 7/1995 Lewinski
D361,105 S 8/1995 Griffin
D362,801 S 10/1995 Milroy
D368,280 S 3/1996 Brown
5,499,858 A 3/1996 Her
5,564,961 A * 10/1996 Spector ..... 446/72
5,605,485 A * 2/1997 Spector ..... 446/72
5,667,419 A 9/1997 Spector
5,683,250 A 11/1997 Palvanas
5,701,878 A * 12/1997 Moore et al. ..... 124/67
5,788,617 A 8/1998 Paris
5,865,438 A 2/1999 Zillox
5,928,053 A 7/1999 Henderson
5,988,442 A 11/1999 Corey et al.
5,992,697 A 11/1999 James
6,027,393 A 2/2000 O'Rourke
6,039,460 A 3/2000 Ng et al.
D424,932 S 5/2000 Seidler
D446,122 S 8/2001 Weinstein et al.
D449,982 S 11/2001 Ferris
6,474,858 B1 11/2002 Liao
D470,761 S 2/2003 Kelvie
6,568,985 B1 5/2003 Binkley
6,638,172 B1 10/2003 Demars
D481,770 S 11/2003 Choy
6,722,679 B2 4/2004 Englert
D494,856 S 8/2004 Hillard
6,790,112 B2 9/2004 Kirk
6,808,436 B1 10/2004 Siu
6,843,695 B1 1/2005 Jackson et al.
D514,633 S 2/2006 Zheng
6,997,770 B2 2/2006 Lapointe
D517,411 S 3/2006 Okimoto
7,025,228 B2 4/2006 Cuisinier
D524,881 S 7/2006 Orlowski et al.
D528,914 S 9/2006 Williams
D536,040 S 1/2007 Orr et al.
7,264,522 B2 9/2007 Lee et al.
7,281,642 B2 10/2007 Orlowski
D557,356 S 12/2007 Johnston et al.
D557,357 S 12/2007 Johnston et al.
D558,278 S 12/2007 Johnston et al.
D558,279 S 12/2007 Chen et al.
D564,854 S 3/2008 Thompson
D570,687 S 6/2008 Kelders et al.
D574,443 S 8/2008 Wong
D590,027 S 4/2009 Chia
2002/0074343 A1* 6/2002 Johnson et al. ..... 222/61
2003/0071077 A1 4/2003 Panzarella
2003/0124922 A1 7/2003 Sowry et al.
2003/0156950 A1 8/2003 Ostrowiecki
2005/0106963 A1 5/2005 Ross
2005/0184098 A1 8/2005 Dixon
2005/0196287 A1 9/2005 Olich
2006/0027596 A1 2/2006 Walther et al.
2007/0000942 A1 1/2007 Wong et al.
2008/0035680 A1 2/2008 Orlowski
2008/0051002 A1 2/2008 Chung Wong
2008/0054019 A1 3/2008 Stechschulte et al.
2008/0121652 A1 5/2008 Orlowski et al.

OTHER PUBLICATIONS

U.S. Appl. No. 29/302,709, filed Jan. 23, 2008, entitled "Shell for Squirting Toy", inventor: Boguslaw Orlowski (now abandoned).

* cited by examiner

SQUIRTING TOY INCLUDING A SUPPLEMENTAL RESERVOIR SYSTEM AND METHODS THEREOF

CROSS REFERENCE TO RELATED APPLICATION

This application is a continuation-in-part of U.S. patent application Ser. No. 11/860,617 filed on Sep. 25, 2007, now U.S. Pat. No. 7,571,837 and is a continuation-in-part of U.S. application Ser. No. 10/942,326, filed Sep. 16, 2004, now U.S. Pat. No. 7,281,642, the contents of which are incorporated herein by reference in their entirety.

FIELD OF THE INVENTION

The present invention relates to a squirting toy capable of squirting water received from a reservoir and/or from an external source.

BACKGROUND

Squirt guns are well known in many forms in the prior art. Numerous squirt guns and squirting toys are made and have been made over the years for use by persons while swimming in or standing adjacent to a swimming pool, which are adapted to quickly take in water from the swimming pool for squirting. One such toy is called MAX LIQUIDATOR™ and is sold by Prime Time Toys Ltd. This toy, representative of many such squirting toys, is basically comprised of a housing having a nozzle at its squirting end. A piston, which includes a graspable handle, is adapted to slide within the housing so that, when the nozzle end of the housing is submerged in the pool and the piston is pulled backwards, water is drawn into the housing through the nozzle. And when the piston is subsequently forced forwardly, that water is forced from the housing, through the nozzle, towards a target, in a powerful stream.

Additionally, many squirt guns of the prior art are constructed in a manner that entraps air and thereby inadvertently enables those guns to partially float in water, but do not float when no air is entrapped. The degree of such buoyancy is relative to the amount of water that has been taken into the gun and the longevity of such buoyancy is relative to the amount of air leakage from the housing.

There are also floating toy "swimming noodles" in the prior art, which are made of resilient floating closed-cell polymer foam. These toys are used to provide buoyancy to the user while swimming. Because these toys are often left floating in the pool when not in use, their softness eliminates the safety threat that they would otherwise pose.

There are also many squirt guns constructed to include a reservoir. These reservoirs come in many forms, but are generally coupled to the body of the squirt guns and can operate only when the reservoir is attached to the gun and use the reservoir as the only source of water for the squirt gun.

SUMMARY OF THE INVENTION

In some embodiments, the squirting toy can include a housing that can include an interior surface, an exterior surface, a first end that can include an opening, and a second end that can include an opening. In some embodiments, the squirting toy can include a piston slidably engaged with the interior surface of the housing and connected to a shaft, the shaft extending from the second end of the housing through the opening and can include an handle portion external to the housing, and a water reservoir receiving region that can include a water reservoir engagement mechanism. In some embodiments, a water receiving valve can provide fluid communication with the housing and a soft non-water-absorbing shell can be disposed over a portion of the housing.

In some embodiments, a squirting toy can include a housing that can include an interior surface, an exterior surface, a first end that can include an opening, and a second end that can include an opening. In some embodiments, the squirting toy can include a piston slidably engaged with the interior surface of the housing and connected to a shaft, the shaft extending from the second end of the housing through the opening and can include an handle portion external to the housing, and a water reservoir receiving region that can include a water reservoir engagement mechanism. In some embodiments, a water receiving valve can provide fluid communication with the housing, a pressure valve can be in fluid communication with the housing, and a soft non-water-absorbing shell can be disposed over a portion of the housing.

In some embodiments, the pressure valve can be located within the piston. In some embodiments, the pressure valve can further include a spring wherein the spring can compress, opening the valve allowing a fluid to pass from one side of the piston to the other. In some embodiments, the fluid can pass through the piston.

In some embodiments, a fluid can enter from a hole in the first end of the housing and/or the reservoir receiving region.

In some embodiments, the water reservoir valve can be coupled to the housing and/or the shell.

In some embodiments, the water reservoir valve can be coupled to a water reservoir.

In some embodiments, the water reservoir valve can be mechanically opened by inserting a reservoir into reservoir receiving region, the relative movement (e.g., displacement) of the piston and the housing, a user input actively opening the valve, and/or a pressure differential between the reservoir's pressure and the housing pressure and/or the environmental pressure.

In some embodiments, the water reservoir valve can include a first opening and a second opening and the first opening can be slidably placed over the second opening such that when superposed a fluid can pass through the first opening and second opening into the housing.

In some embodiments, the water reservoir receiving region can mate with a standard water bottle.

In some embodiments, the water reservoir receiving region can further include a thread for mating with a standard water bottle.

In some embodiments, the soft shell can provide buoyancy to keep the toy afloat in water when the chamber is, for example, filled to its maximum capacity with water and can form a protective surface over the housing, wherein the shell can extend between a nozzle and a slide bushing, each of the nozzle and the slide bushing can have an outer dimension smaller than the outermost dimension of the shell, whereby the softness of the shell offers safety benefits.

In some embodiments, the slide bushing can be at least partially encapsulated by the shell offering safety benefits.

In some embodiments, the cross-section of the shell can be round, oval, square, rectangular, triangular, or any other suitable shape.

In some embodiments, the soft shell can be disposed over substantially the entirety of the housing.

In some embodiments, a soft shell can be disposed over a portion of the handle portion.

In some embodiments, the housing can have a volume, the volume being capable of expansion or contraction by movement of the piston, whereby the squirting toy can be adapted to draw in water into the volume through the opening in the end of the housing during expansion of the volume while the hole is submerged and eject water through the opening during contraction of the volume.

In some embodiments, the safety benefits can include softness and/or absence of hard edges.

In some embodiments, the shaft can be substantially hollow and the piston can further include a hole such that air can be displaced from the housing through the hole and into the shaft.

In some embodiments, at least one handle can be disposed over a portion of the shell.

In some embodiments, the squirting toy can include a cap, that cap being capable of covering the reservoir receiving region.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying drawings and figures wherein.

DETAILED DESCRIPTION OF THE EXEMPLARY EMBODIMENTS

Figure 1:
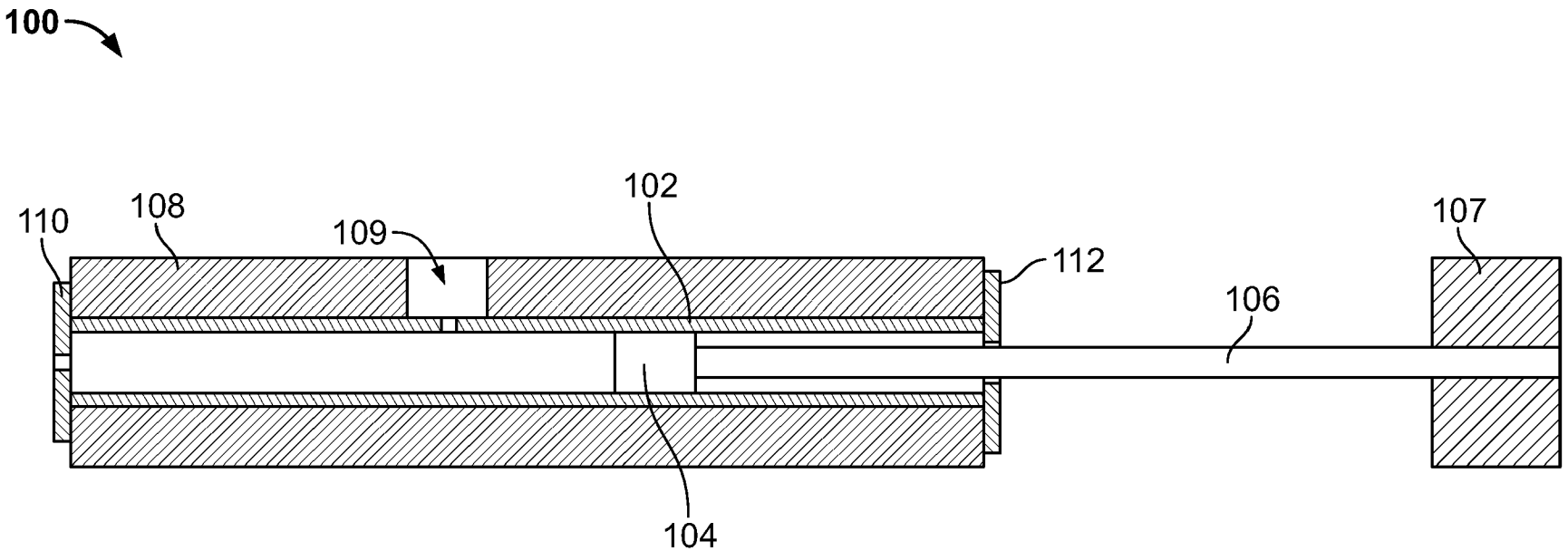
FIG. 1 depicts elements of a squirting gun of the present invention.

Referring to FIG. 1, in accordance with an exemplary embodiment of the invention, a squirting toy 100 can include a housing 102 surrounding a piston 104, piston 104 can be attached to a shaft 106, and at least some portion of housing 102 can be surrounded by a shell 108. In accordance with an exemplary embodiment of the invention, a nozzle 110 can be located at one end of the housing for accelerating water pushed by piston 104 inside housing 102 out of housing 102. In accordance with an exemplary embodiment of the invention, a slide bushing 112 can be located at one end of the housing 102 that can retain piston 104 within housing 102. In accordance with an exemplary embodiment of the invention, force can be applied to handle portion 107 causing piston 104 to displaceably move along the length of housing 102.

In accordance with an exemplary embodiment of the invention, squirting toy 100 can include a reservoir receiving region 109 capable of coupling a reservoir to squirting toy 100, such that squirting toy 100 can squirt water from an attached reservoir (not shown) and/or water drawn in from an external source (e.g., a pool, lake, ocean, etc.). In accordance with an exemplary embodiment of the invention, a reservoir valve (not shown) can be used to provide fluid communication between an attached reservoir (not shown) and housing 102.

In accordance with an exemplary embodiment of the invention, a pressure valve (not shown) can be used to provide fluid communication between a first portion of housing 102 (e.g., located on one side of piston 104) and a second portion of housing 102 (e.g., located on another side of piston 104) and/or a first portion of housing 102 and the external environment.

Figure 2:
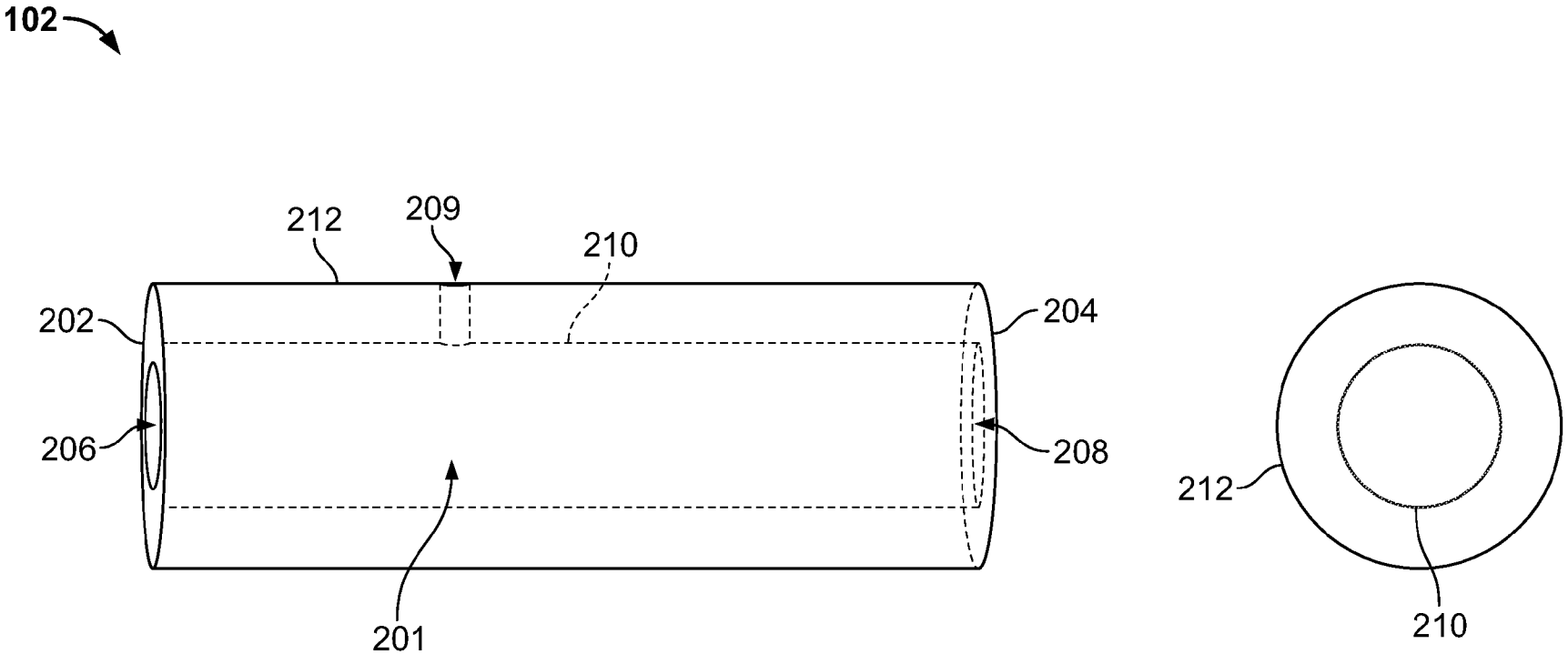
FIG. 2 depicts a housing element of the system and method of the present invention.

Referring to FIG. 2, in accordance with an exemplary embodiment of the invention, housing 102 can be substantially cylindrical in shape and can have an opening passing from the first end of the housing to the second end of the housing. For example, housing 102 can be a substantially rigid tube that encloses a hollow cylindrical chamber.

In accordance with an exemplary embodiment of the invention, housing 102 can include a first surface end 202 including an opening 206 and a second surface end 204 including an opening 208 and a material can extend from first surface end 202 to second surface end 204. As the material extends from first surface end 202 including opening 206 to second surface end 204 including opening 208, chamber 201 can be created such that housing 102 can include an internal surface 210 and an external surface 212.

In accordance with an exemplary embodiment of the invention, opening 206 and opening 208 can be any reasonable shape, such as, but not limit to round, square, polygonal, triangular, star shaped, or any other reasonable shape for receiving piston 104 and/or a fluid (e.g., water). For ease, openings 206 and 208 are depicted as round, this is in no way meant to be a limitation. Further, chamber 201 connecting opening 206 and opening 208 can follow any desired path. For example, chamber 201 can change shape when connecting opening 206 and opening 208. By way of example, opening 206 and 208 may be square however the length of chamber 201 connecting the square openings can be substantially round.

In accordance with an exemplary embodiment of the invention, housing 102 can have any reasonable cylindrical shape, such as, but not limited to, round cylindrical, square cylindrical, polygonal cylindrical, star cylindrical, triangular cylindrical, or any other reasonable cylindrical shape. For ease, each of the figures illustratively depicts housing 102 as having a round cylindrical shape, this is in no way meant to be a limitation.

In accordance with an exemplary embodiment of the invention, internal surface 210 and external surface 212 can be substantially smooth and/or can be substantially rough. Internal surface 210 can be substantially smooth, for example, to ease the passage of piston 104 through the length of housing 102. External surface 210 can be substantially rough and/or substantially smooth, for example, to allow positioning (e.g., frictional positioning, etc.) of shell 108.

In accordance with an exemplary embodiment of the invention, an opening 209 can be located in housing 102 passing from internal surface 210 to external surface 212, this opening 209 can be for providing fluid communication between a reservoir (not shown) and housing 102 and/or can be for coupling a reservoir (not shown) to housing 102.

Figure 3:
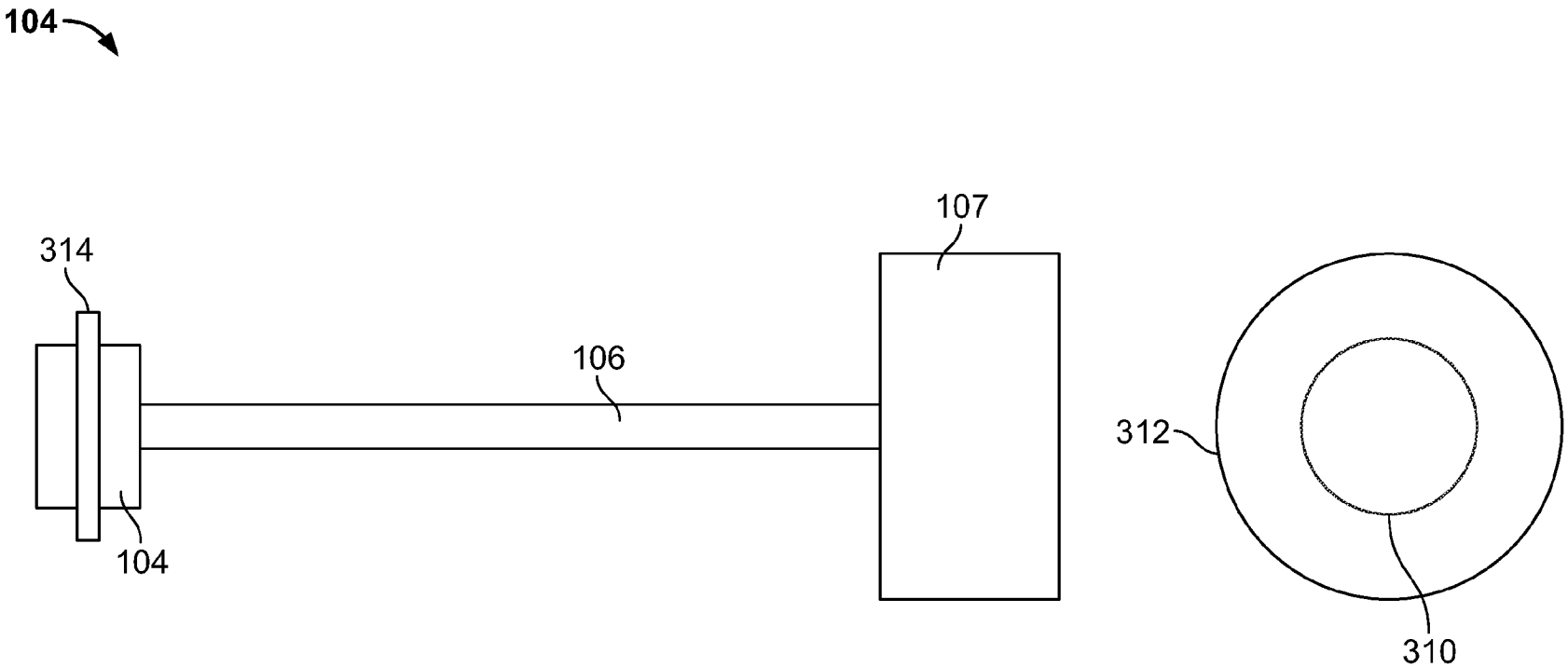
FIG. 3 depicts a piston, shaft, and an handle portion element of the system and method of the present invention.

Referring to FIG. 3, in accordance with an exemplary embodiment of the invention, shaft 106, handle portion 107, and/or piston 104 can be substantially cylindrical in shape. In accordance with an exemplary embodiment of the invention, shaft 106, handle portion 107, and/or piston 104 can be substantially solid, can be substantially tubular, and/or any combination thereof.

In accordance with an exemplary embodiment of the invention, if shaft 106, handle portion 107, and/or piston 104 is tubular (e.g., has an opening passing through at least some of the length its body) the cross sectional shape of the internal surface (not shown) can be any reasonable shape, such as, but not limit to round, square, polygonal, triangular, star shaped, or any other reasonable shape. For ease, the cross sectional shape of shaft 106, handle portion 107, and/or piston 104 is depicted/described as round, this is in no way meant to be a limitation.

In accordance with an exemplary embodiment of the invention, shaft 106, handle portion 107, and/or piston 104 can have any reasonable cylindrical shape, such as, but not limited to, round cylindrical, square cylindrical, polygonal cylindrical, star cylindrical, triangular cylindrical, or any other reasonable cylindrical shape. For ease, each of the figures illustratively depicts shaft 106, handle portion 107, and/or piston 104 as having a round cylindrical shape, this is in no way meant to be a limitation. In accordance with an exemplary embodiment of the invention, shaft 106 can be substantially the same shape as piston 104 and/or handle portion 107. For example, shaft 106, piston 104 can be round cylindrical having diameters substantially equal to each other and/or diameters different than each other. For ease, each of the figures illustratively depicts shaft 106 and piston 104 as round having different diameters, this is in no way meant to be a limitation.

In accordance with an exemplary embodiment of the invention, handle portion 107 can include an external surface 312 designed to couple with the internal surface, discussed below, of a shell. For example, the cross sectional shape of external surface 312 and the internal surface of a shell can be substantially similar.

In accordance with an exemplary embodiment of the invention, piston 104 can include an external surface 310 having a cross sectional shape substantially similar to the cross sectional shape of internal surface 210 of housing 102. By way of example, if the cross sectional shape of internal surface 210 is round having a diameter of 0.5 inches then the cross sectional shape of external surface 310 can be round having a diameter of just slightly smaller than 0.5 inches. In accordance with an exemplary embodiment of the invention, piston 104 can include a seal 314 (e.g., an O-ring) designed to allow piston 104 to displaceable move within the length of housing 102 while forcing water out of housing 102.

In accordance with an exemplary embodiment of the invention, shaft 106, piston 104, and/or handle portion 107 can include a coupling region. In accordance with an exemplary embodiment of the invention, the coupling region can be located such that shaft 106 can be coupled to piston 104 and/or a handle portion 107.

In accordance with an exemplary embodiment of the invention, the coupling region of one component (e.g., shaft 106, piston 104, and/or handle portion 107) can be coupled to the coupling region of another component (e.g., shaft 106, piston 104, and/or handle portion 107) by inserting the coupling region of one component into the coupling region of another component. In accordance with an exemplary embodiment of the invention, the coupling region of one component can remain coupled to the coupling region of another component by any reasonable interaction, such as, but not limited to, a mechanical interaction (e.g., thread interaction, frictional interaction, etc.), a chemical interaction (e.g., bonding, melting, etc.), an adhesive interaction (e.g., adhesively contacting the coupling regions), or any other reasonable interaction capable of coupling the coupling regions.

In accordance with an exemplary embodiment of the invention, shaft 106, piston 104, and/or handle portion 107 can be substantially one unit. For ease, they are depicted as three separate elements, this is in no way meant to be a limitation.

Figure 4:
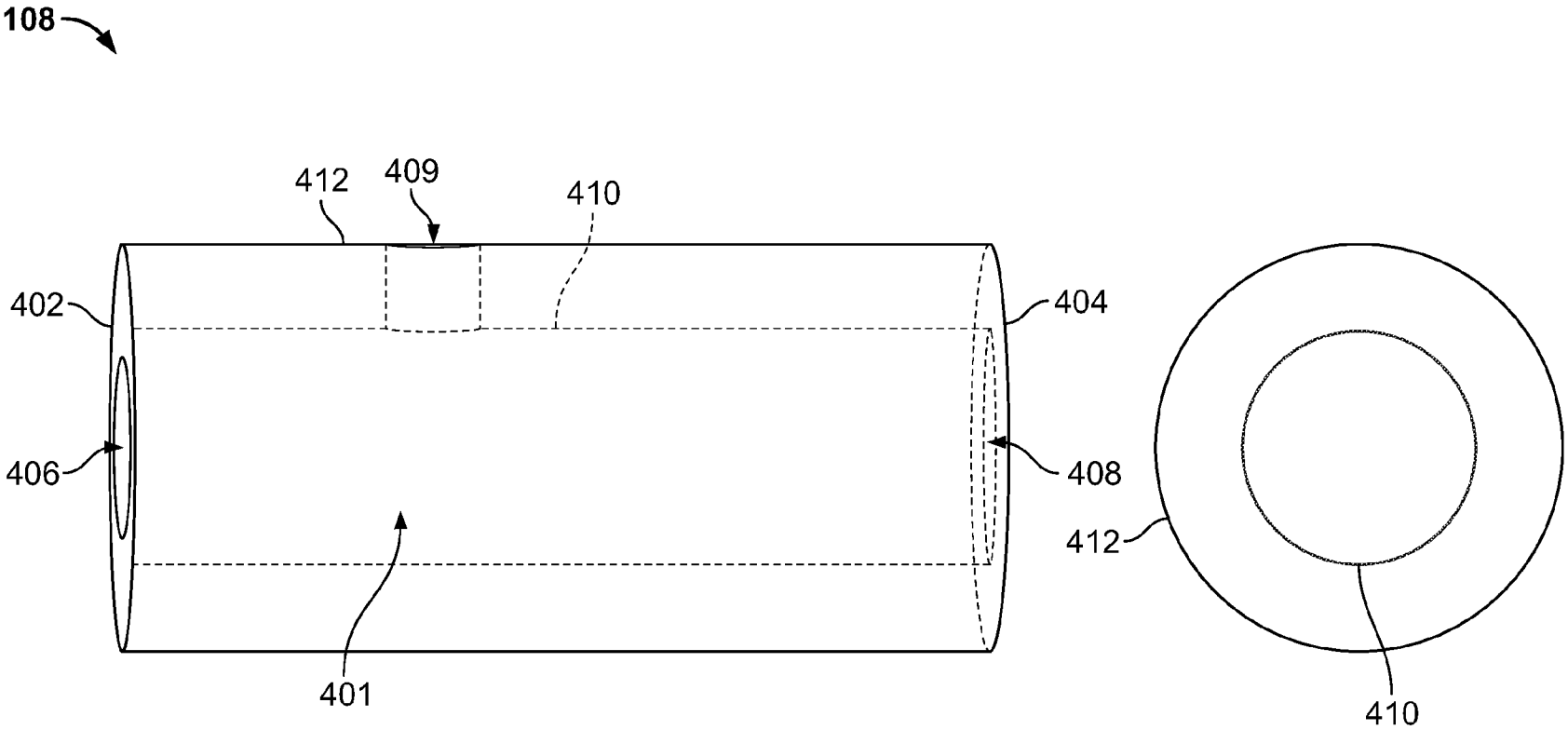
FIG. 4 depicts a shell element of the system and method of the present invention.

Referring to FIG. 4, in accordance with an exemplary embodiment of the invention, shell 108 can be substantially cylindrical in shape and can have an opening passing from the first end of the shell to the second end of the shell. For example, shell 108 can be a tube.

In accordance with an exemplary embodiment of the invention, shell 108 can include a first surface end 402 including an opening 406 and a second surface end 404 including an opening 408 and a material can extend from first surface end 402 to second surface end 404. As the material extends from first surface end 402 including opening 406 to second surface end 404 including opening 408, channel 401 can be created such that shell 108 can include an internal surface 410 and an external surface 412.

In accordance with an exemplary embodiment of the invention, opening 406 and opening 408 can be any reasonable shape, such as, but not limit to round, square, polygonal, triangular, star shaped, or any other reasonable shape for receiving at least a region of housing 102 and/or handle portion 107. For ease, openings 406 and 408 are depicted as round, this is in no way meant to be a limitation. Further, channel 401 connecting opening 406 and opening 408 can follow any desired path. For example, channel 401 can change shape when connecting opening 406 and opening 408. By way of example, opening 406 and 408 may be square however the length of channel 401 connecting the square openings can be substantially round.

In accordance with an exemplary embodiment of the invention, shell 108 can have any reasonable cylindrical shape, such as, but not limited to, round cylindrical, square cylindrical, polygonal cylindrical, star cylindrical, triangular cylindrical, or any other reasonable cylindrical shape. For ease, each of the figures illustratively depicts shell 108 as having a round cylindrical shape, this is in no way meant to be a limitation.

In accordance with an exemplary embodiment of the invention, internal surface 410 and external surface 412 can be substantially smooth and/or can be substantially rough. Internal surface 410 can be substantially smooth, for example, to ease the passage of housing 102 and/or handle portion 107 through a length of shell 108. External surface 240 can be substantially rough and/or substantially smooth, for example, to increase friction gripping for a user (e.g., a child with a wet hand).

In accordance with an exemplary embodiment of the invention, an opening 409 can be located in shell 108 passing from internal surface 410 to external surface 412, this opening 409 can be for providing fluid communication between a reservoir (not shown) and housing 102 and/or can be for coupling a reservoir (not shown) to shell 108.

In accordance with an exemplary embodiment of the invention, shell 108 can be constructed of a substantially soft material such as, but not limited to, closed cell polyethylene foam. In accordance with an exemplary embodiment of the invention, the substantially soft material can act as a protective surface. For example, the substantially soft material can minimize hard edges such that a child is less likely to injure themselves or another while using squirting toy 100. In accordance with an exemplary embodiment of the invention, the substantially soft material can be substantially buoyant such that the squirting toy 100 can remain afloat in water, for example, even when housing 102 and/or a reservoir (not shown) is substantially filled with water. As squirting toy 100 can be substantially buoyant, squirting toy 100 may be substantially less difficult to lose while using and/or squirting toy 100 can be used to aide an individual (e.g., a child) who has difficulty staying afloat in water. In some embodiments, the toy will not sink to the bottom of a body of water. For example, because the toy will not sink in a pool the toy is less difficult and/or less dangerous for a child to retrieve.

In accordance with an exemplary embodiment of the invention, shell 108 can extend at least some length of housing 102 and/or handle portion 107 such that, but not limited to, shell 108 can substantially encapsulate housing 102 and/or handle portion 107, shell 108 can encapsulate a region of housing 102 and/or handle portion 107, shell 108 can cover a portion of the external surface of housing 102 and/or handle portion 107, or any shell can cover and/or extend any reasonable amount of housing 102 and/or handle portion 107.

In accordance with an exemplary embodiment of the invention, at least one shell 108 can be located on housing 102 and/or handle portion 107. For example, a first shell 108 can be located on housing 102 and a second shell 108 can be located on handle portion 107; a first shell 108 and a second shell 108 can be located on housing 102 and a third shell 108 can be located on handle portion 107; a first shell 108 and a second shell 108 can be located on housing 102 and a third shell 108 and fourth shell 108 can be located on handle portion 107; or any reasonable number of shells 108 can be located on housing 104 and/or handle portion 107.

Figure 5B:
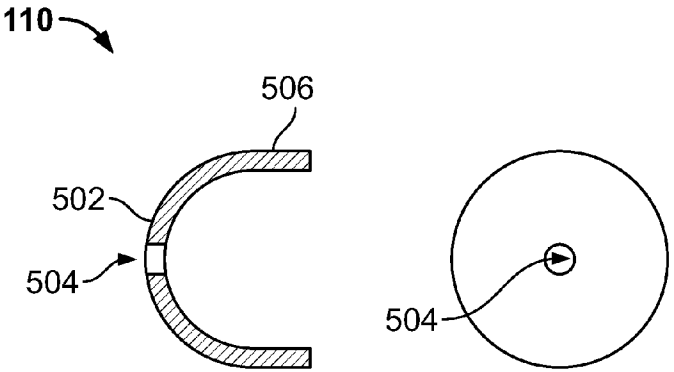
FIGS. 5A-5D depict a nozzle element of the system and method of the present invention.
Figure 5A:
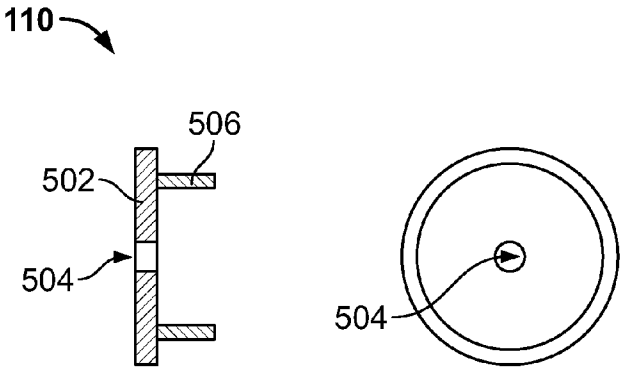
Figure 5D:
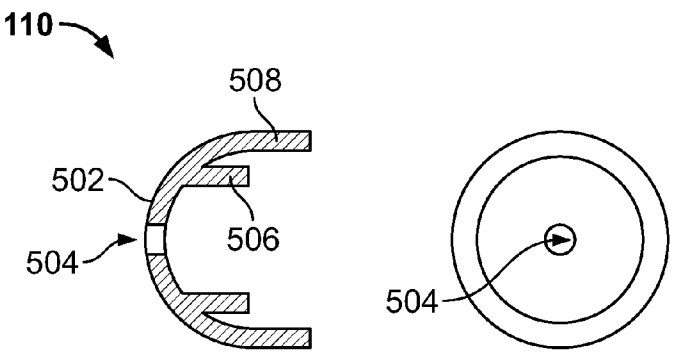
Figure 5C:
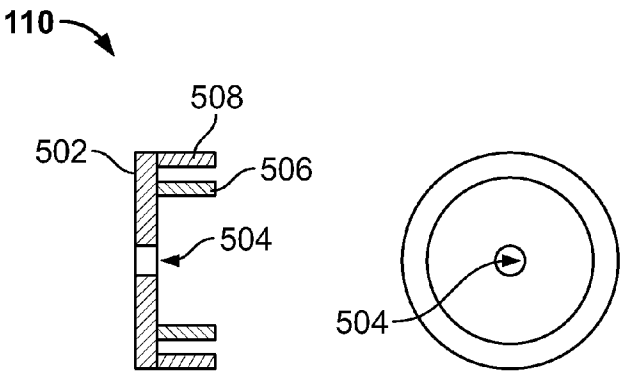

Referring to FIGS. 5A-D, in accordance with an exemplary embodiment of the invention, nozzle 110 can include a body 502 including an opening 504 such that water can be accelerated out of housing 102. Referring to FIGS. 5A-5B, in accordance with an exemplary embodiment of the invention, nozzle 110 can include substantially one dimensional (e.g., flat, planar, etc.) and/or two dimensional (e.g., curved, rounded, pyramidal, etc.) body 502 including protrusions 506 that can be coupled to shell 108 and/or housing 102. Referring to FIGS. 5C-5D, in accordance with an exemplary embodiment of the invention, nozzle 110 can include substantially one dimensional (e.g., flat, planar, etc.) and/or two dimensional (e.g., curved, rounded, pyramidal, etc.) body 502 including protrusions 506 that can be coupled to shell 108 and/or housing 102 and protrusions 508 that can be coupled to shell 108 and/or housing 102. In accordance with an exemplary embodiment of the invention, opening 504 can have a cross sectional size of about 2 millimeters to 8 millimeters. It will be understood that nozzle 110 and housing 102 can be substantially one unit.

Figure 6:
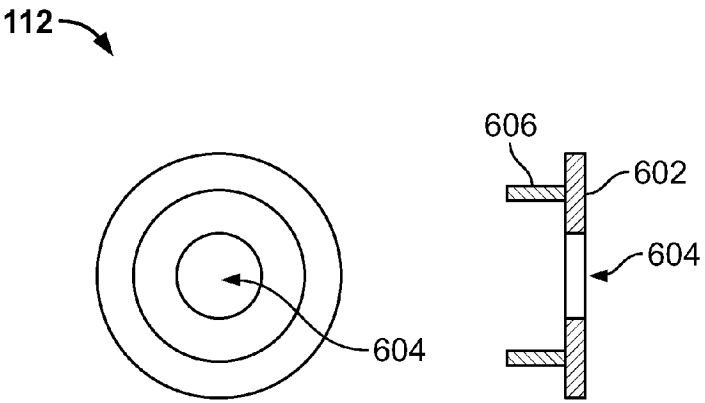
FIG. 6 depicts a slide bushing element of the system and method of the present invention.

Referring to FIG. 6, in accordance with an exemplary embodiment of the invention, a slide bushing 112 located at one end of the housing 102 can retain piston 104 within housing 102 and reduce leakage of water out of housing 102. Slide bushing 112 can include a body 602 that can include an opening 604 for slidably receiving shaft 106 and can include protrusions 606 that can be coupled to housing 102 and/or shell 108. In accordance with an exemplary embodiment of the invention, a seal (e.g., an o-ring) can be located on slide bushing 112 to further reduce leakage of water out of housing 102. It will be understood that slide bushing 112 and housing 102 can be substantially one unit.

Figure 7A:
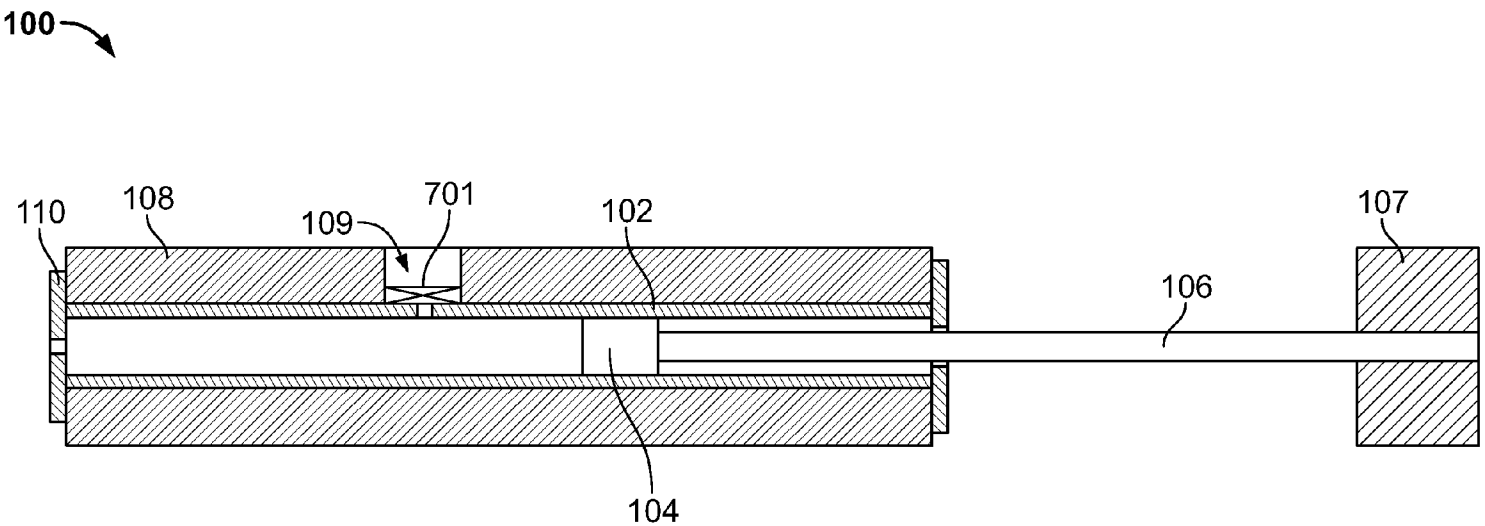
FIGS. 7A-7C depict a reservoir valve element of the system and method of the present invention.

Referring to FIG. 7A, in accordance with an exemplary embodiment of the invention, a reservoir valve 701 can be used to provide fluid communication between an attached reservoir (not shown) and housing 102. In accordance with an exemplary embodiment of the invention, reservoir valve 701 can be located at the reservoir receiving region 109 and/or at the reservoir. For example, reservoir valve 701 can be substantially attached to the squirting toy (e.g., coupled to shell 108 and/or housing 102) and/or reservoir valve 701 can be not-substantially attached to the squirting toy (e.g., coupled to a reservoir, inserted into the opening of a reservoir, etc.). For ease, reservoir valve 701 is depicted as being coupled to shell 108 and/or housing 102, this is in no way meant to be a limitation.

In accordance with an exemplary embodiment of the invention, reservoir valve 701 can be any reasonable valve capable of providing fluid communication from a reservoir to housing 102. In accordance with an exemplary embodiment of the invention, reservoir valve 701 can be, but is not limited to, a valve mechanically opened when a reservoir is inserted into reservoir receiving region 109, a valve mechanically opened by the relative movement (e.g., displacement) of piston 104 and housing 102, a valve mechanically opened by a user actively opening the valve (e.g., a user pushing a button, turning a knob, etc.), a valve mechanically opened based on a pressure differential between the reservoir's pressure and the housing pressure and/or the environmental pressure, and/or any combination thereof.

Figure 7B:
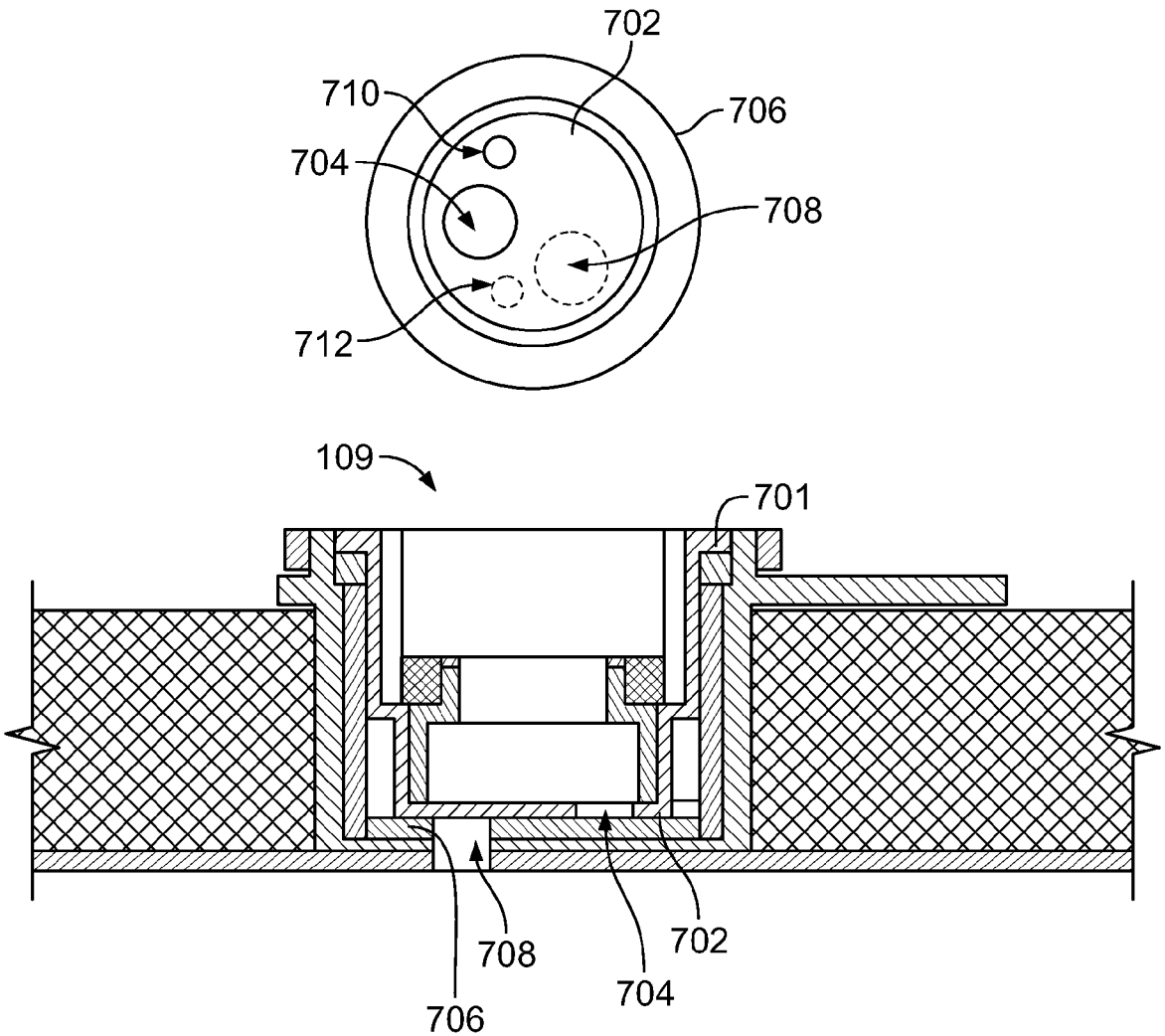
Figure 7C:
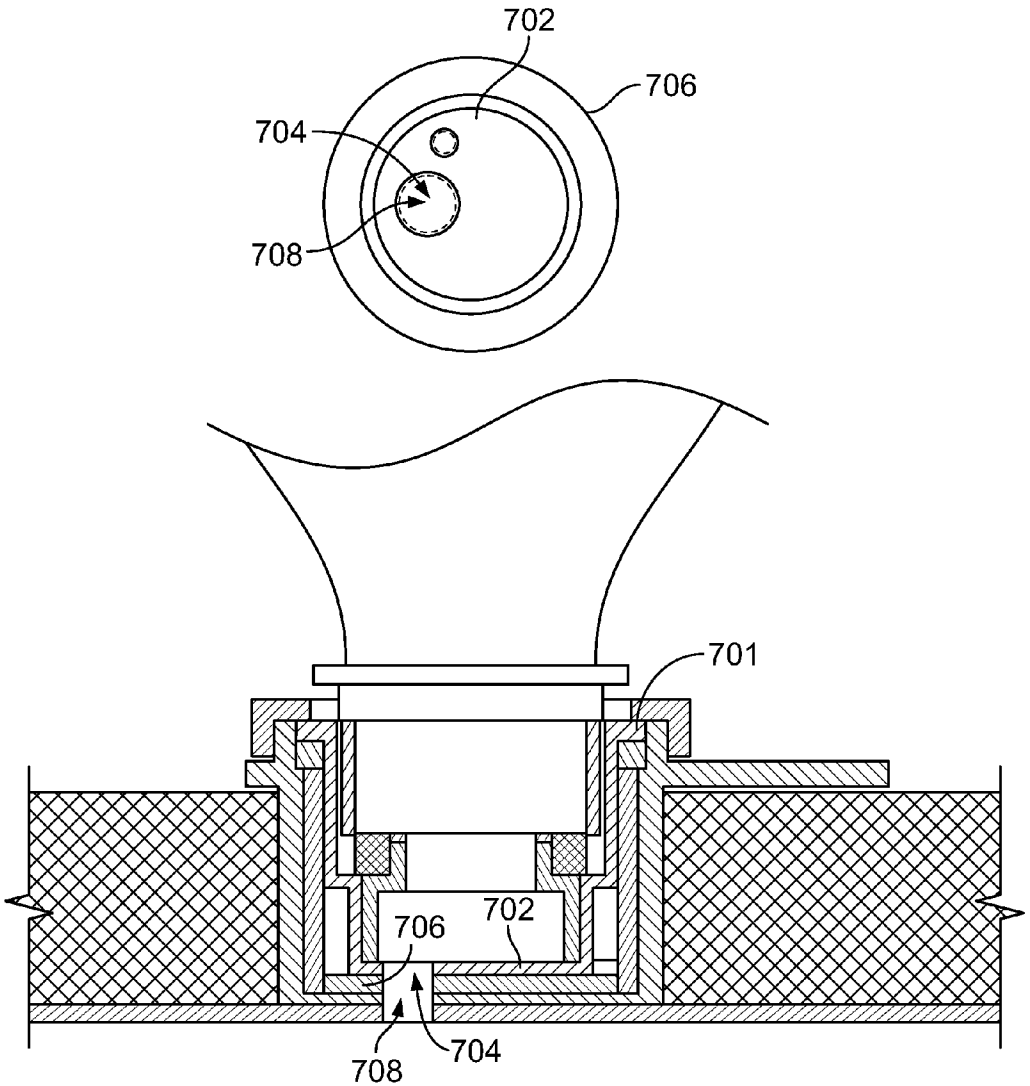

Referring to FIG. 7B-C, in accordance with an exemplary embodiment of the invention, reservoir valve 701 can be opened by inserting a reservoir into reservoir receiving region 109. Reservoir valve 701 can include a first rotatable element 702 having a first opening 704 and a second rotatable element 706 having a second opening 708, the valve being opened when first opening 704 and second opening 708 are aligned, the valve being closed when first opening 704 and second opening 708 are not aligned.

Referring to FIG. 7B, in accordance with an exemplary embodiment of the invention, reservoir valve 701 can be in an closed position such that first opening 704 and second opening 708 are not aligned. For example, first opening 704 and second opening 708 can be in parallel planes, however, they are not aligned vertically.

Referring to FIG. 7C, in accordance with an exemplary embodiment of the invention, first element 702 and second element 706 can be rotated relative to each other when a reservoir (e.g., a standard water bottle) is screwed into receiving region 109 such that the after the reservoir is secured, the reservoir is turned (e.g., an additional rotation) causing first element 702 and/or second element 706 to rotate relative to each other causing opening 704 and opening 708 to align. When aligned, water from the reservoir can flow (e.g., be in fluid communication) from the reservoir into housing 102 (e.g., by gravitational force, pressure differential, etc.).

In accordance with an exemplary embodiment of the invention, first element 702 and second element 706 can include additional openings 710 and 712, respectively, that can be used to allow air to flow between the reservoir and housing 102. For example, openings 704, 708 can be for water flow having a cross section of about 2 millimeters to 16 millimeters and additional openings 710, 712 can be for air flow having a cross section of about 0.5 millimeters to 4 millimeters. Openings 704, 708, 710, and 712 can be any reasonable shape, such as, but not limited to, round, square, polygonal, star shaped, triangular, or any other reasonable shape for allowing communication between a reservoir and housing 102. For ease, openings 704, 708, 710, and 712 are illustratively depicted as round, however, this is in no way meant as a limitation.

Figure 8A:
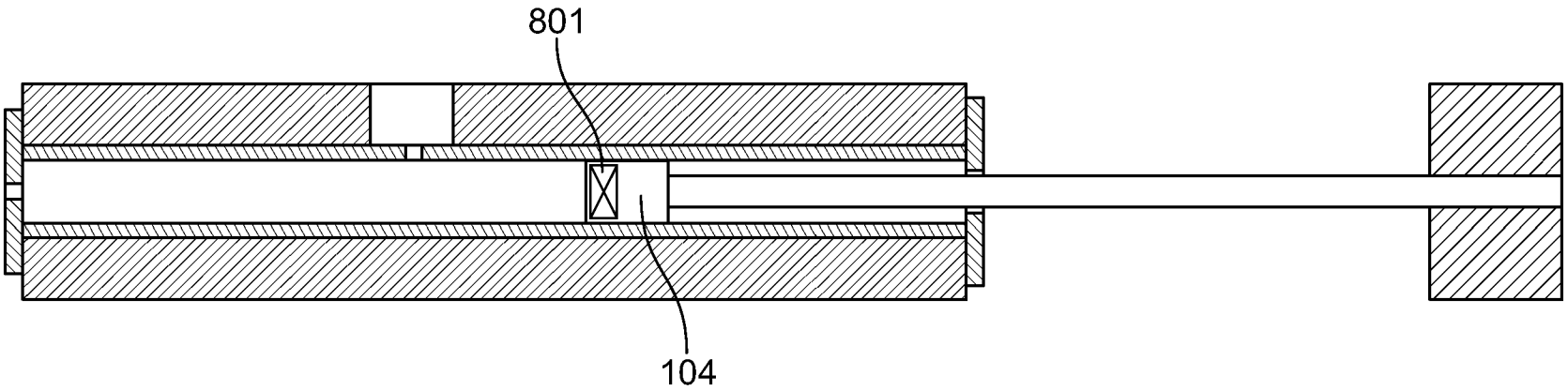
FIGS. 8A-8C depict a pressure valve element of the system and method of the present invention.

Referring to FIG. 8A, in accordance with an exemplary embodiment of the invention, a pressure valve 801 can be used to provide fluid communication between a first side of piston 104 and a second side of piston 104. In accordance with an exemplary embodiment of the invention pressure valve 801 can be located at piston 104.

In accordance with an exemplary embodiment of the invention, pressure valve 801 can be any reasonable valve capable of providing fluid communication between a first side of piston 104 and a second side of piston 104. In accordance with an exemplary embodiment of the invention, pressure valve 801 can be, but is not limited to, a valve mechanically opened by the relative movement (e.g., displacement) of piston 104 and housing 102, a valve mechanically opened based on a pressure differential between the second side of piston 104 and first side of piston 104 and/or the environmental pressure, and/or any combination thereof.

Figure 8B:
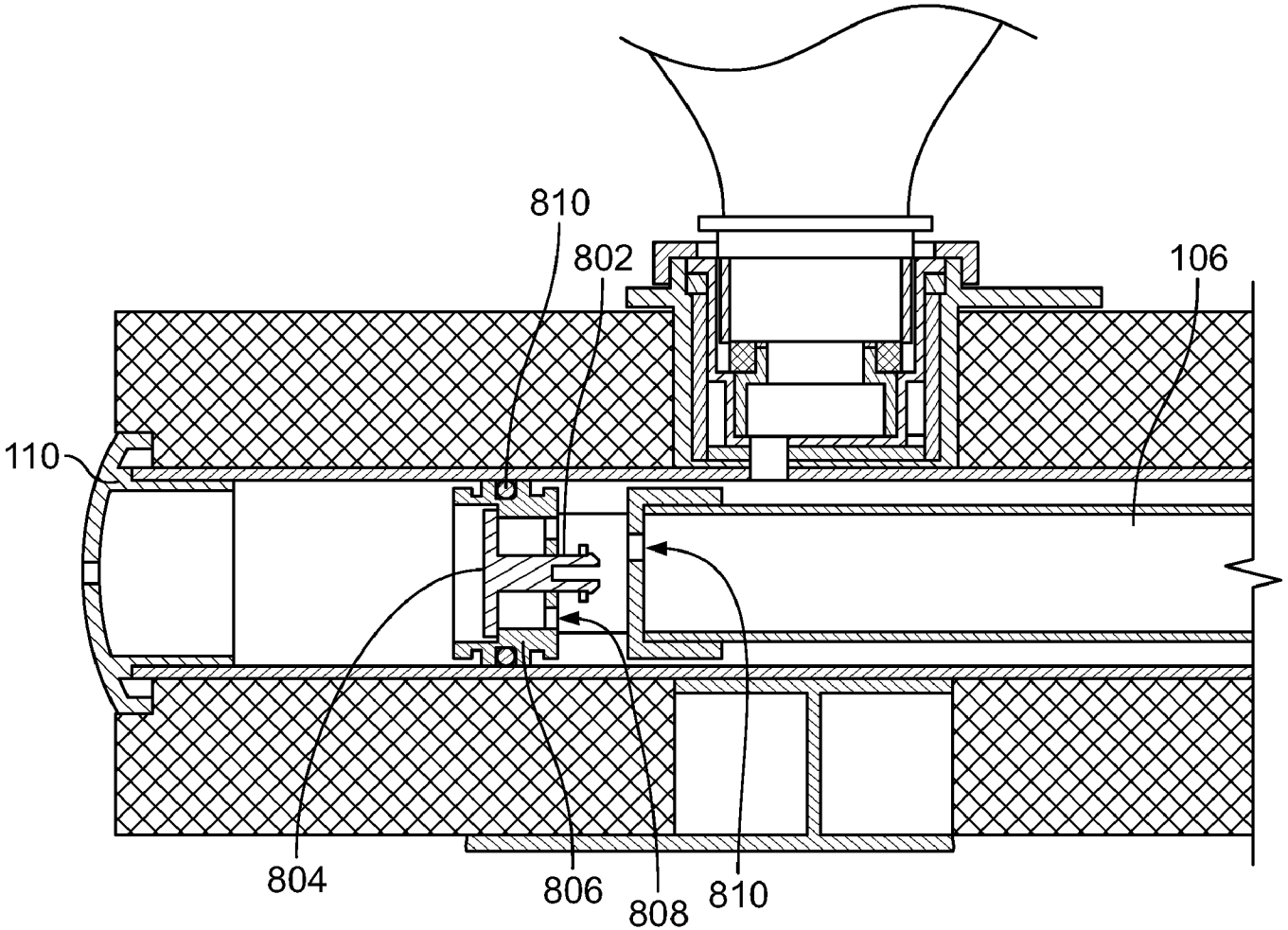
Figure 8C:
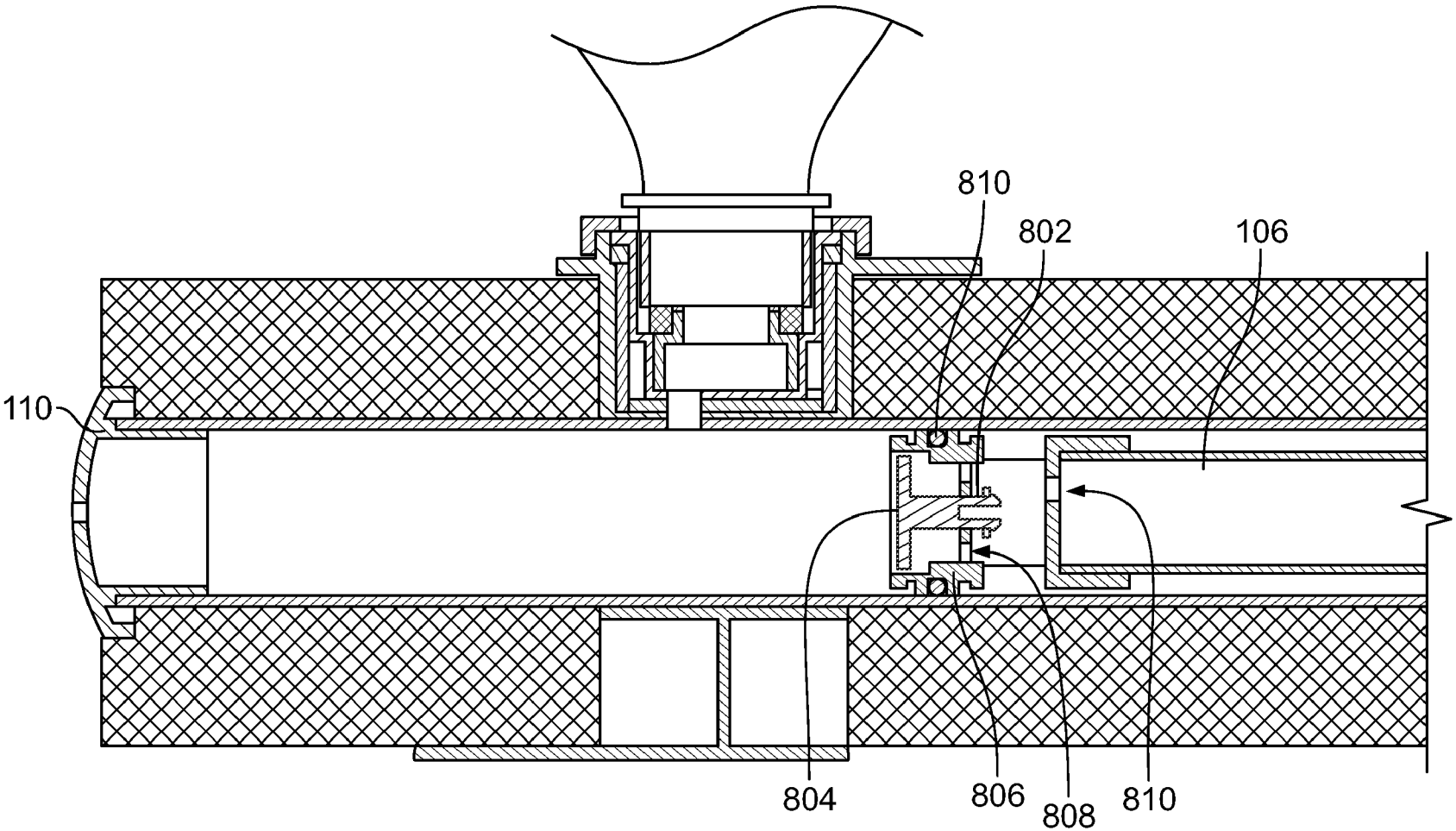

Referring to FIGS. 8B-C, in accordance with an exemplary embodiment of the invention, pressure valve 801 can include a first element including an opening, a second element covering the opening in the first element, and a compressible body for retaining the second element over the opening such that when pressure is applied to one side of the first element that overcomes the retaining force of the compressible body the opening can be exposed and water can flow from one side of the piston to the other.

Referring to FIG. 8B, in accordance with an exemplary embodiment of the invention, pressure valve 801 can be closed when a tension spring 802 presses first element 804 against second element 806 covering an opening 808 in second element. For example, when piston 104 is displaced towards nozzle 110 opening 808 is substantially covered by first element 804 causing pressure valve 801 to be closed. In accordance with an exemplary embodiment of the invention, a seal 810 (e.g., an o-ring) can be used to minimize water flow around piston 104. Thus, as the piston continues to move toward the nozzle 110 water is expelled from the housing by piston 104.

Referring to FIG. 8C, in accordance with an exemplary embodiment of the invention, pressure valve 801 can be opened when tension spring 802 is compressed allowing first element 804 to displace from second element 806 such that opening 808 is exposed and water can flow through opening 808. For example, water can collect between shaft 106 and housing 102, and when piston 104 is displaced away from nozzle 110 this collected water pushes against first element 804 overcoming the retention force of spring 802 causing opening 808 to be exposed such that the collected water is moved from one side of piston 104 to the other side. Further, when sufficient water has been moved the pressure can no longer overcome the spring retention force of spring 802 and opening 808 is covered (e.g., closed). In accordance with an exemplary embodiment of the invention, this moved water can then be pushed by piston 104 and accelerated, by nozzle 110, out of housing 102.

In accordance with an exemplary embodiment of the invention, a small opening 810 can be located in pressure valve 801 that can, for example, allow air to displace in shaft 106, for example, when water flows through space 808.

Figure 9:
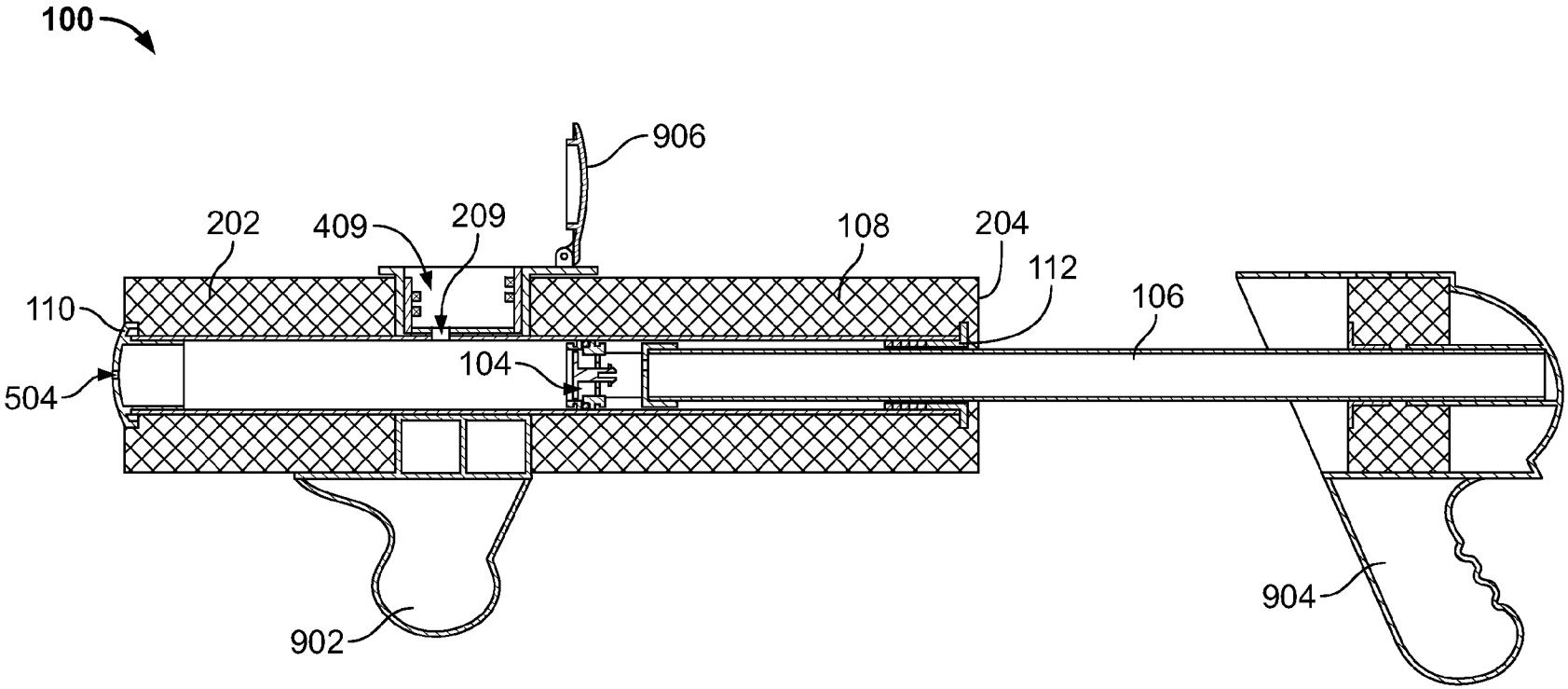
FIG. 9 depicts elements of the system and method of the present invention.

Referring to FIG. 9, in accordance with an exemplary embodiment of the invention, opening 209 (e.g., within in opening 409) can be located a distance from opening 504 in nozzle 110 such that water can be drawn in as a piston is 104 displaces away opening 504, for example, the distance from opening 504 to about opening 209. In accordance with an exemplary embodiment of the invention, squirting gun 100 can include two water sources, an external source drawn in through opening 504 and a reservoir source drawn in from opening 209.

In accordance with an exemplary embodiment of the invention, squirting toy 100 can further include a first gripping handle 902 and/or a second gripping handle 904. The gripping handles can surround at least a portion of shell 108 and/or housing 102, for example, reinforcing the housing and/or supporting a reservoir. In accordance with an exemplary embodiment of the invention, a cap 906 can be at attached to shell 108 and/or handle 902. Cap 906 can be designed to cover reservoir receiving region 110 when a reservoir (not shown) is not received by it. In accordance with an exemplary embodiment, cap 102 can substantially cover reservoir receiving region 110 such that water can be drawn in from opening 502 when piston 104 is displaced beyond opening 209.

In accordance with an exemplary embodiment of the invention, nozzle 110 and/or slide bushing 112 can be at least partially surrounded by shell 108. For example, only a rounded surface of nozzle 110 may protrude from first surface 202 and/or slide bushing 112 can be located a distance inward (e.g., subset) from second surface 204. This may be done to remove any hard edges from squirting gun 100.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A squirting toy comprising:

a housing having a chamber, the housing comprising an interior surface, a first end comprising an opening, and a second end comprising an opening;

a piston slidably engaged with the interior surface of the housing and connected to a shaft, the shaft extending from the second end of the housing and comprising an handle portion external to the housing;

a water reservoir receiving region comprising a water reservoir engagement mechanism and a valve in fluid communication with the housing; and a soft non-water-absorbing shell disposed over a portion of the housing.

2. The squirting toy of claim 1, wherein fluid can enter from at least one of the opening in the first end and the reservoir receiving region.

3. The squirting toy of claim 1, wherein the water reservoir valve is at least one of coupled to at least one of the housing and the shell.

4. The squirting toy of claim 1, wherein the water reservoir valve is coupled to a water reservoir.

5. The squirting toy of claim 1, wherein the water reservoir valve is mechanically opened by at least one of inserting a reservoir into reservoir receiving region, the relative movement of the piston and the housing, a user input actively opening the valve, and a pressure differential between the reservoir's pressure and at least one of the housing pressure and the environmental pressure.

6. The squirting toy of claim 1, wherein the water reservoir valve is further comprising:

a first opening and a second opening; and wherein the first opening can be slidably placed over the second opening such that fluid a fluid can pass through the first opening and second opening into the housing.

7. The squirting toy of claim 1, wherein the water reservoir receiving region mates with a standard water bottle.

8. The squirting toy of claim 1, wherein the water reservoir receiving region is further comprising a thread for mating with a standard water bottle.

9. The squirting toy of claim 1, wherein the soft shell is further comprising:

providing buoyancy to keep the toy afloat in water when the housing is filled to its maximum capacity with water;

forming a protective surface over the housing; and wherein the shell extends between a nozzle and a slide bushing, each of the nozzle and the slide bushing having an outer dimension smaller than the outermost dimension of the shell, whereby the softness of the shell offers safety benefits.

10. The squirting toy of claim 9, wherein the slide bushing is at least partially encapsulated by the shell offering safety benefits.

11. The squirting toy of claim 1, wherein the soft shell is disposed over substantially the entirety of the housing.

12. The squirting toy of claim 1, further comprising a soft shell disposed over a portion of the handle portion.

13. The squirting toy of claim 1, wherein the housing is further comprising a volume, the volume capable of expansion or contraction by movement of the piston, whereby the squirting toy is adapted to draw in water into the volume through the opening in the first end during expansion of the volume while the opening is submerged and eject water through the opening during contraction of the volume.

14. The squirting toy of claim 1, wherein the safety benefits comprise at least one of softness and absence of hard edges.

15. The squirting toy of claim 1, wherein the shaft is substantially hollow and piston is further comprising a hole such that air can be displaced from the housing through the hole and into the shaft.

16. The squirting toy of claim 1, further comprising at least one handle disposed over a portion of the shell.

17. The squirting toy of claim 1, further comprising a cap capable of covering the reservoir receiving region.

18. A squirting toy comprising:

a housing having a chamber, the housing comprising an interior surface, an exterior surface, a first end comprising an opening, a second end comprising an opening;

a piston slidably engaged with the interior surface of the housing and connected to a shaft, the shaft extending from the second end of the housing and comprising an handle portion external to the housing;

a water reservoir receiving region comprising a water reservoir engagement mechanism;

a water receiving valve providing fluid communication with the housing;

a pressure valve in fluid communication with the housing; and a soft non-water-absorbing shell disposed over a portion of the housing.

19. The squirting toy of claim 18, wherein the pressure valve is located within the piston.

20. The squirting toy of claim 19, wherein the pressure valve is further comprising a spring wherein the spring compresses opening the valve allowing a fluid to pass from one side of the piston to the other.

21. The squirting toy of claim 19, wherein the fluid passes through the piston.

22. The squirting toy of claim 18, wherein fluid can enter from at least one of the opening of the first end and the reservoir receiving region.

23. The squirting toy of claim 18, wherein the water reservoir valve is coupled to at least one of the housing and the shell.

24. The squirting toy of claim 18, wherein the water reservoir valve is coupled to a water reservoir.

25. The squirting toy of claim 18, wherein the water reservoir valve is mechanically opened by at least one of inserting a reservoir into reservoir receiving region, the relative movement of the piston and the housing, a user input actively opening the valve, and a pressure differential between the reservoir's pressure and at least one of the housing pressure and the environmental pressure.

26. The squirting toy of claim 18, wherein the water reservoir valve is further comprising:

a first opening and a second opening; and wherein the first opening can be slidably placed over the second opening such that fluid can pass through the first opening and second opening into the housing.

27. The squirting toy of claim 18, wherein the water reservoir receiving region mates with a water bottle.

28. The squirting toy of claim 18, wherein the water reservoir receiving region is further comprising a thread for mating with a standard beverage bottle.

29. The squirting toy of claim 18, wherein the soft shell is further comprising:

providing buoyancy to keep the toy afloat in water when the housing is filled to its maximum capacity with water;

forming a protective surface over the housing; and wherein the shell extends between a nozzle and a slide bushing, each of the nozzle and the slide bushing having an outer dimension smaller than the outermost dimension of the shell, whereby the softness of the shell offers safety benefits.

30. The squirting toy of claim 29, wherein the slide bushing is at least partially encapsulated by the shell offering safety benefits.

31. The squirting toy of claim 18, wherein the soft shell is disposed over substantially the entirety of the housing.

32. The squirting toy of claim 18, further comprising a soft shell disposed over a portion of the handle portion.

33. The squirting toy of claim 18, wherein the housing is further comprising a volume, the volume being capable of expansion or contraction by movement of the piston, whereby the squirting toy is adapted to draw in water into the volume through the opening in the first end during expansion of the volume while the opening is submerged and eject water through the opening during contraction of the volume.

34. The squirting toy of claim 18, wherein the safety benefits comprise at least one of softness and absence of hard edges.

35. The squirting toy of claim 18, wherein the shaft is substantially hollow and piston is further comprising a hole such that air can be displaced from the housing through the hole and into the shaft.

36. The squirting toy of claim 18, further comprising at least one handle disposed over a portion of the shell.

37. The squirting toy of claim 18, further comprising a cap capable of covering the reservoir receiving region.

* * * * *